US009281566B2

(12) United States Patent
Apostolos et al.

(10) Patent No.: US 9,281,566 B2
(45) Date of Patent: Mar. 8, 2016

(54) STACKED BOW TIE ARRAY WITH REFLECTOR

(71) Applicant: AMI Research & Development, LLC, Windham, NH (US)

(72) Inventors: John T. Apostolos, Lyndeborough, NH (US); Judy Feng, Nashua, NH (US); William Mouyos, Windham, NH (US)

(73) Assignee: AMI Research & Development, LLC, Windham, NH (US)

( * ) Notice: Subject to any disclaimer, the term of this patent is extended or adjusted under 35 U.S.C. 154(b) by 6 days.

(21) Appl. No.: 13/763,903

(22) Filed: Feb. 11, 2013

(65) Prior Publication Data

US 2013/0222199 A1 Aug. 29, 2013

Related U.S. Application Data

(60) Provisional application No. 61/596,951, filed on Feb. 9, 2012.

(51) Int. Cl.

| | |
|---|---|
| ***H01Q 9/28*** | (2006.01) |
| ***H01Q 19/10*** | (2006.01) |
| ***H01Q 21/26*** | (2006.01) |

(52) U.S. Cl.

CPC ..... *H01Q 9/28* (2013.01); *H01Q 19/106* (2013.01); *H01Q 21/26* (2013.01)

(58) Field of Classification Search

CPC ..... H01Q 9/16; H01Q 21/26; H01Q 21/08
USPC ..... 343/789, 795, 797, 813, 815, 818, 798, 343/819

See application file for complete search history.

(56) References Cited

U.S. PATENT DOCUMENTS

| | | | | |
|---|---|---|---|---|
| 5,696,372 | A | 12/1997 | Grober et al. | |
| 6,072,439 | A * | 6/2000 | Ippolito et al. | 343/797 |
| 6,373,446 | B2 | 4/2002 | Apostolos | |
| 6,417,816 | B2 | 7/2002 | Sadler et al. | |
| 6,480,158 | B2 | 11/2002 | Apostolos | |
| 6,753,816 | B1 | 6/2004 | Apostolos | |
| 6,795,021 | B2 * | 9/2004 | Ngai et al. | 343/700 MS |
| 6,833,815 | B2 | 12/2004 | Apostolos | |
| 6,842,154 | B1 | 1/2005 | Apostolos | |
| 6,847,328 | B1 * | 1/2005 | Libonati et al. | 343/700 MS |
| 6,900,770 | B2 | 5/2005 | Apostolos | |
| 7,148,850 | B2 | 12/2006 | Baliarda et al. | |
| 7,358,920 | B2 * | 4/2008 | Apostolos et al. | 343/789 |
| 7,436,369 | B2 | 10/2008 | Apostolos | |
| 2008/0231528 | A1 | 9/2008 | Guixa Arderiu | |

* cited by examiner

*Primary Examiner* — Michael C Wimer
(74) *Attorney, Agent, or Firm* — Cesari and McKenna, LLP

(57) ABSTRACT

A stacked bow tie antenna array structure is placed within, for example a rectangular reflector. Spaces between the bow tie elements and the reflector are filled with close spaced conductive plates.

8 Claims, 5 Drawing Sheets

STACKED BOW TIE ARRAY WITH REFLECTOR

CROSS REFERENCE TO RELATED APPLICATIONS

This patent application claims the benefit of U.S. Provisional Patent Application Ser. No. 61/596,951 filed Feb. 9, 2012 entitled "LOW RCS STACKED BOW TIE ARRAY WITH REFLECTOR" and is related to U.S. patent application Ser. No. 13/536,445 filed Jun. 28, 2012 entitled "LOW-PROFILE, VERY WIDE BANDWIDTH AIRCRAFT COMMUNICATIONS ANTENNAS USING ADVANCED GROUND-PLANE TECHNIQUES". The content of each these referenced patent applications is hereby incorporated by reference in their entirety.

BACKGROUND

1. Technical Field

This patent application relates to low profile, conformal antennas.

2. Background Information

It is known that wide bandwidth, miniaturized antennas can be provided using planar conductors fed through frequency-dependent impedance elements such as meander lines. By arranging these components in an appropriate configuration, the electrical properties of the antenna can be passively and automatically optimized over a wide bandwidth. This approach is particularly useful in aircraft and other low profile applications since no part of the antenna needs to protrude beyond the skin of the vehicle or other enclosure such as a wireless telephone. The overall design can also be adapted to wireless devices and laptop computers and the like where the antenna height can be minimized.

U.S. Pat. No. 6,373,446 issued to Apostolos discusses a crossed-element, meander line loaded antenna comprising a ground plane and a dual bow-tie configuration with four triangular sections. Each of the triangular sections has a side member substantially perpendicular from the ground plane and a triangle-shaped top member with a based end and a vertex end. The top member is disposed substantially parallel to the ground plane with the base end abutting the side member, being separated by a side gap. Each vertex end is arranged in close proximity to one another separated by a vertex gap, and there is a first connector operatively connecting a first pair of the triangular sections each at the vertex end. A second connector operatively connects a second pair of the triangular sections each at the vertex end.

U.S. Pat. No. 6,833,815 also to Apostolos discloses a flush-mounted meander line loaded antenna having a conductive cavity. The antenna radiating elements are positioned at the top portion of the conductive cavity such that the top plates of the antenna are flush with a surrounding ground plane surface that meets the upper edge of the cavity.

In another implementation described in U.S. Pat. No. 7,436,369 to Apostolos a wideband antenna can be provided using these techniques with the meander line loads placed at or below the plane of the conductive surface which carries the cavity.

SUMMARY

According to various teachings herein, a low profile antenna is provided by a reflective cavity-backed central radiator structure. The central radiator structure is formed from multiple bow tie antenna elements. Each bow tie element is composed of a pair of triangle-shaped conductive radiating surfaces. The triangle surfaces in each pair are positioned to face one another at their vertices forming the bow tie shape. Two (or more) bow tie elements are then stacked over one another such that the base of a triangle of a first bow tie element is disposed adjacent to the base of a triangle of a second bow tie element.

The arrangement results in spaces between the elements of the central radiating structure and the cavity, such as at the sides of the bow ties, that do not contain radiating surfaces. In one arrangement these spaces are filled with one, and preferably more than one, additional conductive surfaces such as metallic surfaces. These additional metallic surfaces are isolated from the radiating bow tie elements. Filling in the spaces in this way results in a reduced radar cross section and improved gain performance.

In some implementations, passively reconfigurable impedance structure can be disposed between the radiating elements, the conductive cavity, and/or additional metallic surfaces. These passively reconfigurable impedance structures can operate as a frequency dependent coupling between the central radiator and the ground plane elements(s).

When these passively reconfigurable impedances are used, the center radiating element can be designed to operate efficiently, decoupled from the cavity, at a relatively high radiation frequency of interest. The other elements, being coupled to the central radiator in a frequency-dependent fashion, only become active as the frequency decreases.

The frequency dependent couplings may be implemented using meander line structures. The meander line structures may take various forms such as interconnected, alternating, high and low impedance sections disposed over a conductive surface.

The frequency dependent couplings may also take the form of a Variable Impedance Transmission Line (VITL) that consists of a meandering metallic transmission line with gradually decreasing section lengths, with interspersed dielectric portions to isolate the conductive segments. Specific embodiments of the VITL structure may further include electroactive actuators that alter the spacing between dielectric and metal layers to provide a Tunable Variable Impedance Transmission Line (TVITL).

BRIEF DESCRIPTION OF THE DRAWINGS

The description below refers to the accompanying drawings, of which.

DETAILED DESCRIPTION

Figure 1:
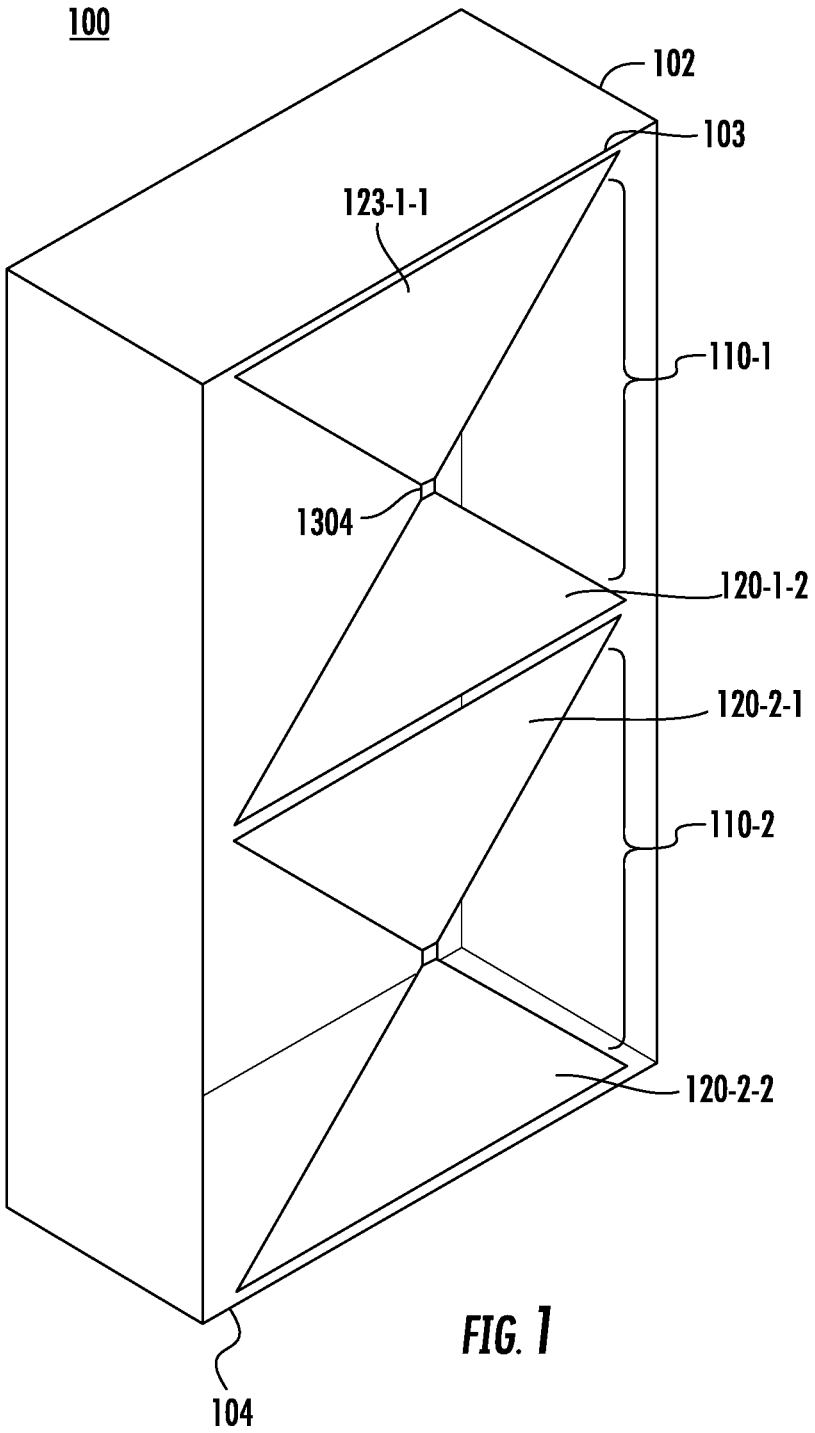
FIG. 1 is a front perspective view of a cavity-backed, stacked bow tie antenna having front openings.

FIG. 1 illustrates a stacked bow tie antenna array backed by a reflective cavity. The arrangement provides high gain, wide band, performance for point to point communication.

More particularly, this version of a stacked bow tie antenna array 100 makes use of a reflector 102. The reflector 102 here is a rectangular box formed of metal or other conductive material. In this configuration, the array 100 includes a central radiator structure provided by two bow tie elements, including a first bow tie element 110-1 and a second bow tie element 110-2, stacked over one another.

An example bow tie element 110-1 consists of an upper triangular section 120-1-1 and a lower section 120-1-2. The bow tie elements 110 are themselves formed of a suitable conductive material such as metal positioned on the face of the reflector cavity 102. The metal can be formed on a dielectric substrate (not shown) or otherwise mechanically supported on the face of the cavity.

Each of the triangular sections 120 has a base end and a vertex end. The upper triangle 120-1-1 of the upper bow tie element 110-1 is disposed with its base end substantially parallel to a top edge 103 of the face of cavity 102, and with its vertex facing the vertex of the lower triangle section 120-1-2. Each vertex end is thus arranged in close proximity to one another separated by a gap 140. Example bow tie element 110-1 is fed by a radio transmitter and/or receiver (not shown) by connecting to a point 130-1 adjacent this junction of the triangular elements 120-1-1 and 120-1-2.

The second bow tie element 110-2 is formed identical or at least similar to the first bow tie element 110-1. The base of the lower triangle 120-1-2 is thus disposed near a center portion of the face of the cavity 102. The base of the lower triangle element 120-2-2 of the lower bow tie 110-2 is positioned near and substantially parallel to a bottom edge 104 of cavity 102, with its vertex facing the vertex of the upper triangle element 120-2-1.

The bow tie elements 110-1 and 110-2 are thus considered to be "stacked" on top of one another such that they lie in a common vertical plane, coincident with or at least parallel to a front face of the reflector 102.

The reflector 102 is otherwise filled with air or other non-conductive material depending of course, on the desired operating frequency.

It should be understood that while only two stacked bow tie elements 110 are shown in FIG. 1, that it is possible to have more pairs of bow tie elements stacked adjacent one another and similarly located over a common reflective cavity 102.

Figure 2A:
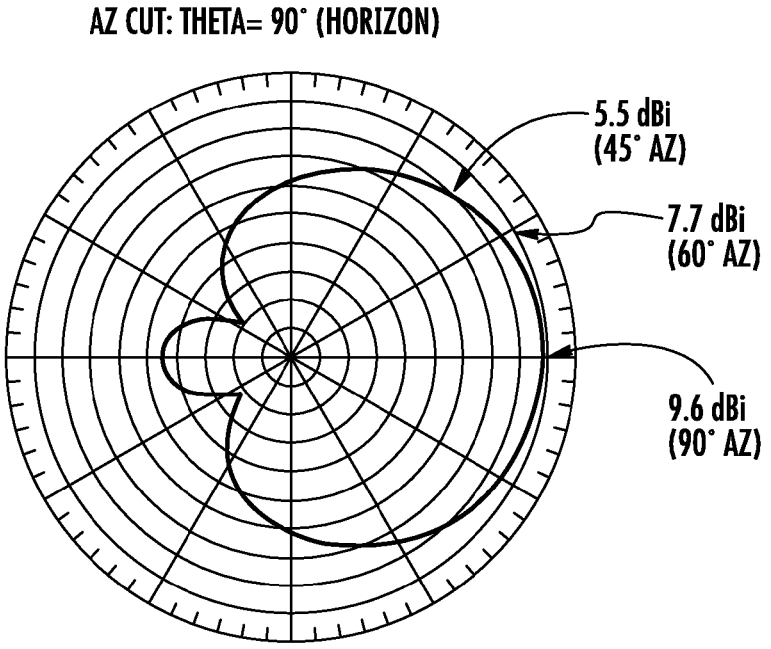
FIGS. 2A and 2B are azimuthal and elevational gain plots for the antenna of FIG. 1.
Figure 2B:
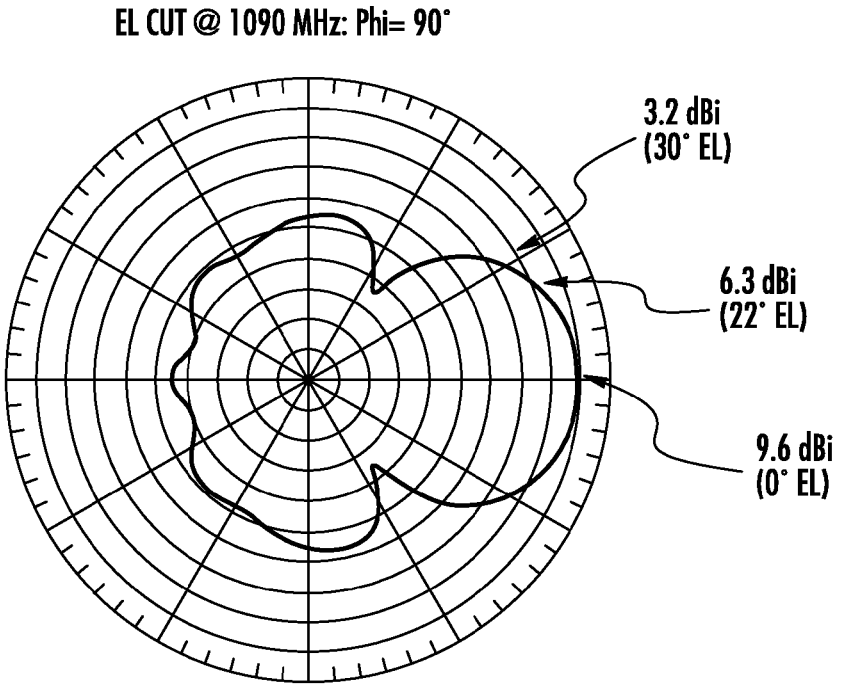

FIGS. 2A and 2B are azimuthal and elevational gain plots for a model of an antenna having the dimensions shown in FIG. 1 (7.0×12.5 inch overall dimension; with the bow tie elements 6.0×6.0 inches each) and operating at 1090 Mega-Hertz (MHz). Note the approximate 9.6 dBi gain at 90 degrees in both azimuth and elevation.

Figure 3:
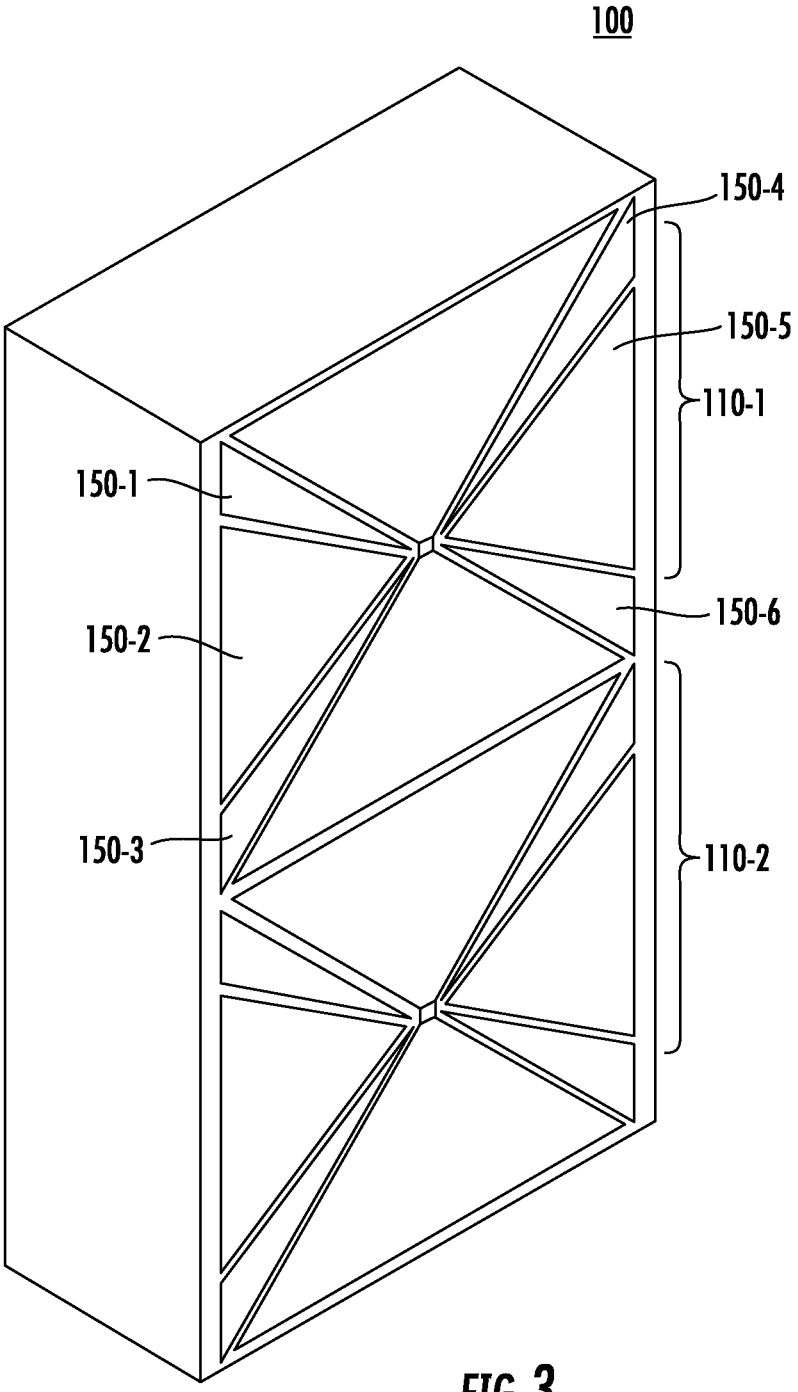
FIG. 3 is a front perspective view of a cavity-backed, stacked bow tie antenna with front filled.

FIG. 3 shows another arrangement that has additional features. By now filling in exposed sections of the array 100 (on the sides of the bow tie elements 110) with closely spaced metallic structures 150, the Radar Cross Section (RCS) performance of the antenna array is further improved with no noticeable degradation of the original performance.

The closed spaced metallic structures 150 in the example shown in FIG. 3 consists of three subsections on each side of each bow tie element 110. Thus for the example bow tie element 110-1 on the left side there are three such closely spaced conductive structures 150-1, 150-2, 150-3 and on the right side there are three analogous closely spaced conductive structures 150-4, 150-5, 150-6. Closely spaced structures 150 are formed as well as on each side of the lower bow tie element 110-2. Note in FIG. 3

The size of the gap between the closely spaced elements 150 in this configuration (7×12.5 inch overall size; 6×6 inch bow ties, for operating at 1090 MHz) was 0.16 inches.

The closely spaced metallic structures 150 may take the form of the spaced apart triangular shaped pieces as illustrated, with the smaller triangle pieces disposed nearest the radiating elements 120. However the metallic structures may have other sizes or shapes. What is important is that a substantial portion of the space to the sides of the bow tie elements 110 is filled with conductive material.

The stacked bow tie array 100 of FIG. 3 otherwise has the same form factor as the stacked bow tie structure of FIG. 1. This results in comparable gain and comparable antenna patterns as the antenna of FIG. 1. However, the metallic structures 150 improve the Radar Cross Section (RCS) performance with no noticeable degradation of the original performance.

Figure 4A:
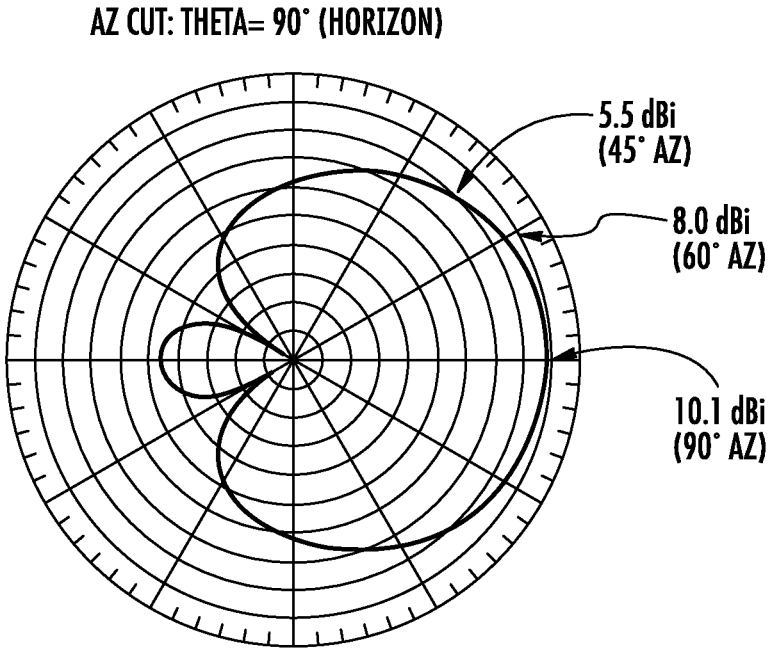
FIGS. 4A and 4B are azimuthal and elevational gain plots for the antenna of FIG. 3.
Figure 4B:
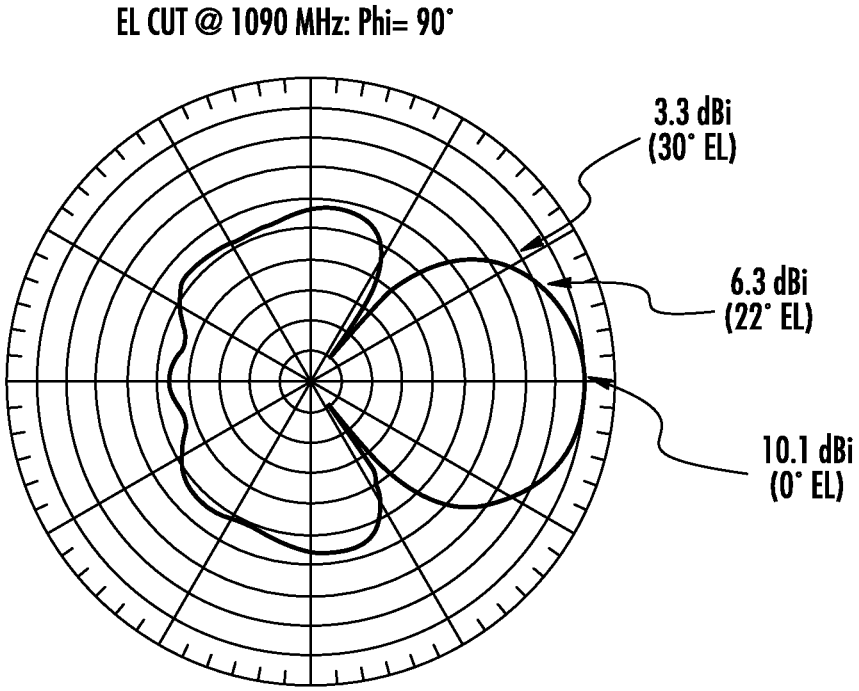

This can be seen by comparing the modeled azimuthal and elevational plots of FIGS. 4A and 4B with those of FIGS. 2A and 2B. With the antenna arrangement of FIG. 3, the gain at 90 degrees azimuth and elevation is now improved to 10.1 dBi at the same 1090 MHz operating frequency.

Figure 5:
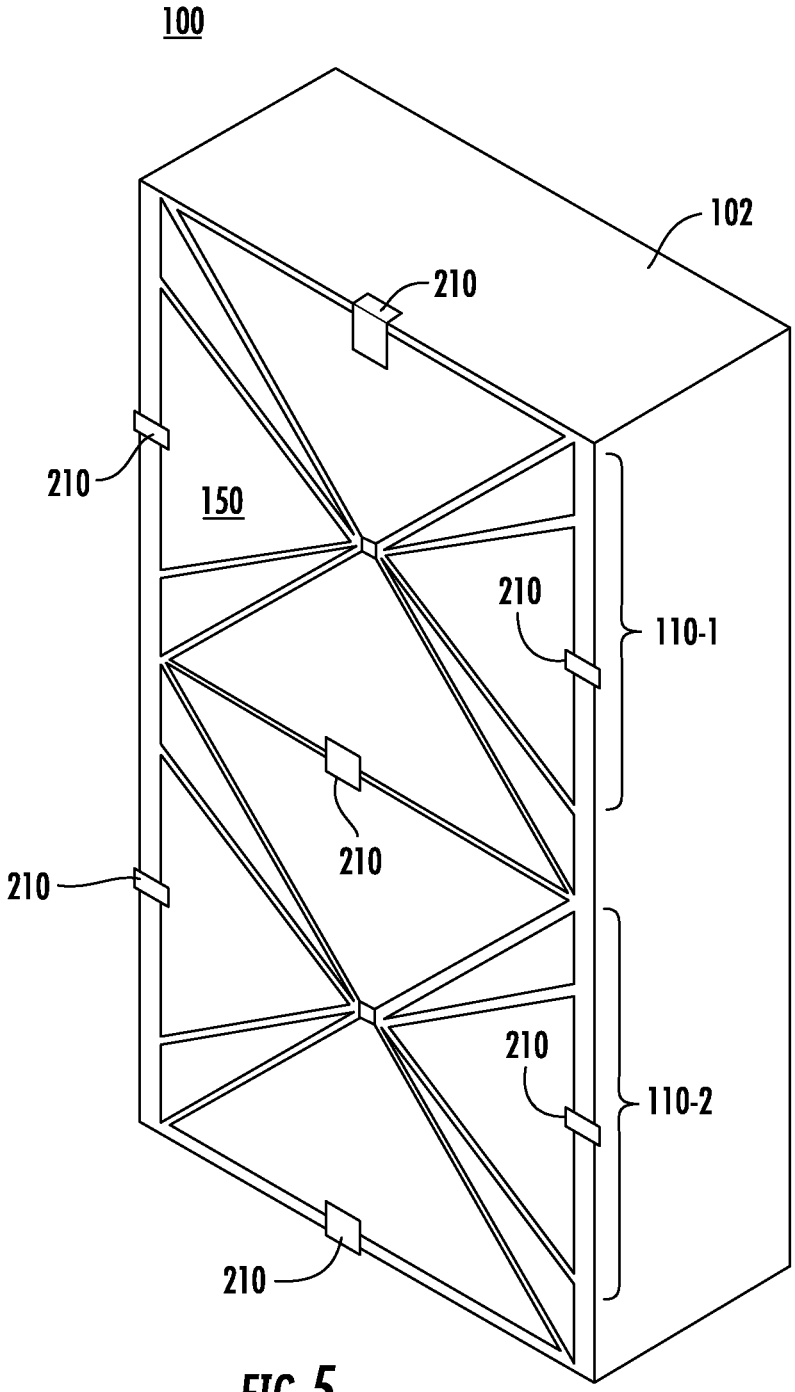
FIG. 5 is a more detailed view of one embodiment of the filled in antenna showing optional loading elements.

FIG. 5 is another embodiment with bow tie elements 110 and closely spaced conductive elements 150 of the same general shape as that of FIG. 3. Here one or more passively reconfigurable surface impedances 210 are placed between one or more portions of the radiating elements 110 and the side walls of the reflective cavity 102. Passively reconfigurable surface impedances 210 operate as a frequency dependent coupling between the radiator(s) and the ground plane represented by the reflective cavity.

The surrounding metallic spaced elements 150 may also be connected to the reflective cavity 102 walls with passively reconfigurable couplings 210. The grounded elements, being coupled to the radiators 110 in a frequency-dependent fashion, only become active as the frequency decreases. The first cell 110-1 makes use of one or more of the other cell(s) 110-2 through the couplers to increase the effective length.

As is known in the art, the frequency dependent couplings 210 may be implemented using meander line structures. The meander line structures may take various forms such as interconnected, alternating, high and low impedance sections disposed over a conductive surface. The frequency dependent couplings may also take the form of a Variable Impedance Transmission Line (VITL) that consists of a meandering metallic transmission line with gradually decreasing section lengths, with interspersed dielectric portions to isolate the conductive segments. Specific embodiments of the VITL structure may further include electroactive actuators that alter the spacing between dielectric and metal layers to provide a Tunable Variable Impedance Transmission Line (TVITL).

While this invention has been particularly shown and described with references to example embodiments thereof, it will be understood by those skilled in the art that various changes in form and details may be made therein without departing from the scope of the invention encompassed by the appended claims.

What is claimed is:

1. An antenna apparatus comprising:

a reflective cavity having a planar front face and one or more each cavity wall having a top edge disposed adjacent the front face, and cavity walls formed of a conductive material; and two or more planar bow tie radiating elements disposed within a plane at or near and parallel to the front face of the reflective cavity, with the bow tie elements each formed of a pair of planar triangle elements each having a vertex end, two sides, and a base end, with the planar triangle elements facing one another at their respective vertex ends, and the planar bow tie elements being positioned adjacent one another to formed a stacked pair of bow tie elements such that a base of a triangle from a first bow tie element is positioned parallel to but adjacent a base of a triangle from a second bow tie element, and further such that at least one space is formed between at least one side of the stacked bow tie elements and the top edge of at least one of the cavity walls; and at least one passive planar conductive structure, disposed in the same plane as the two or more planar bow tie radiating elements, and further disposed within the at least one space between the bow tie elements and the at least one of the cavity walls, and further disposed between two sides of at least one pair of planar triangle elements, and spaced apart from the triangle elements.

2. The apparatus of claim 1 and further comprising:

a plurality of closely spaced isolated passive planar conductive structures disposed within the at least one space between the bow tie elements and the top edge of at least one of the cavity walls, and disposed between two sides of at least one pair of planar triangle elements, the isolated passive metallic structures all being disposed within a plane on or near and parallel to the front face of the cavity and co-planar with the bow tie radiating elements.

3. The apparatus of claim 2 wherein the isolated passive planar metallic structures comprise two or more triangle shaped metallic surfaces.

4. The apparatus of claim 3 wherein the isolated passive planar metallic structures comprise two or more triangle shaped isolated passive planar metallic surfaces located between two adjacent sides of one of the stacked bow tie elements are of at least two different sizes.

5. The apparatus of claim 4 wherein a smaller one of the triangle shaped isolated planar passive metallic surfaces is disposed nearer the base of one of the triangle radiating elements.

6. The apparatus of claim 1 having four cavity walls and further wherein the reflective cavity has a rectangular box shape defined by the four cavity walls.

7. The apparatus of claim 6 further comprising:

two or more variable impedance structures disposed between at least one of the isolated passive metallic structures and the top edge of the cavity walls.

8. The apparatus of claim 1 further comprising:

at least one variable impedance structure disposed between the bases of at least two adjacent bow tie radiating elements.

* * * * *